US008348728B2

(12) United States Patent
Ido et al.

(10) Patent No.: US 8,348,728 B2
(45) Date of Patent: Jan. 8, 2013

(54) GRINDING WHEEL

(75) Inventors: Masahiro Ido, Kariya (JP); Toshio Maruyama, Ibi-gun (JP); Shoichi Sano, Gamagori (JP)

(73) Assignee: JTEKT Corporation, Osaka-shi (JP)

( * ) Notice: Subject to any disclaimer, the term of this patent is extended or adjusted under 35 U.S.C. 154(b) by 459 days.

(21) Appl. No.: 12/639,608

(22) Filed: Dec. 16, 2009

(65) Prior Publication Data

US 2010/0167634 A1 Jul. 1, 2010

(30) Foreign Application Priority Data

Dec. 25, 2008 (JP) ..... 2008-330750

(51) Int. Cl.
*B24B 55/02* (2006.01)

(52) U.S. Cl. ..... 451/541; 451/450

(58) Field of Classification Search ..... 451/548, 451/541, 449, 450, 360
See application file for complete search history.

(56) References Cited

U.S. PATENT DOCUMENTS

| | | | |
|---|---|---|---|
| 1,908,218 | A | 5/1933 | Calvert |
| 3,631,638 | A | 1/1972 | Yoshikawa et al. |
| 3,636,665 | A | 1/1972 | Shaw |
| 4,446,657 | A | 5/1984 | Asaeda et al. |
| 2001/0046835 | A1 | 11/2001 | Wielonski et al. |
| 2003/0150558 | A1 | 8/2003 | Lynn |

FOREIGN PATENT DOCUMENTS

| | | |
|---|---|---|
| JP | 2002-200565 | 7/2002 |

OTHER PUBLICATIONS

Extended European Search Report issued Feb. 21, 2011, in European Patent Application No. 09177709.4.

*Primary Examiner* — Robert Rose
(74) *Attorney, Agent, or Firm* — Oblon, Spivak, McClelland, Maier, & Neustadt, L.L.P.

(57) ABSTRACT

A grinding wheel having a grindstone portion formed on a core includes slippery fluoroplastic coating films that prevent attachment of foreign matter, the coating films being provided on the portions of the core, with which portions the foreign matter can be brought into contact.

10 Claims, 4 Drawing Sheets

GRINDING WHEEL

INCORPORATION BY REFERENCE

The disclosure of Japanese Patent Applications No. 2008-330750 filed on Dec. 25, 2008 including the specification, drawings and abstract, is incorporated herein by reference in its entirety.

BACKGROUND OF THE INVENTION

1. Field of the Invention

The invention relates to a grinding wheel that is used in a state where the grinding wheel is installed on a wheel spindle of a grinding machine.

2. Description of the Related Art

As a grinding wheel for a common grinding machine, a grinding wheel is available, in which a grindstone layer containing CBN or diamond is formed on an outer circumferential surface of a discoid grindstone core made of steel, in which an installation hole for use in installing the grinding wheel on a wheel spindle is formed in the center portion, and in which fixation hole portions for use in fixing the grinding wheel to the wheel spindle or the like are formed around the installation hole. As a grinding wheel for a grinding machine that rotates at a high speed, one that is described in Japanese Patent Application Publication No. 2002-200565 (JP-A-2002-200565), for example, is available, in which the grindstone core is made of aluminum alloy to reduce the weight of the discoid grindstone core. In the grinding wheel, a grindstone layer 35 is formed on the outer circumferential surface of a discoid aluminum alloy core 32 with an adhesive layer 34 interposed therebetween, an installation hole 45 for use in installing the core 32 to a wheel main spindle 21 is formed at a center portion of the core 32, and a plurality of fixation holes 55, 53, and 54 are formed around the installation hole 45 to fix a grinding wheel 31 to the wheel main spindle 21. The grinding wheel 31 is installed on a flange portion of the grinding main spindle 21 via a flange 51 etc. with the use of a plurality of installation bolts 52 through the fixation holes 55, 53, and 54. In addition, nickel-phosphorus (Ni—P) platings 70 and 71 for corrosion proof against a coolant are applied on the predetermined portions of the both end surfaces of the core 32, which portions can be splashed with coolant during grinding.

However, regarding the above-described related art, a situation sometimes occurs where, as machining of workpieces with the use of the grinding wheel is continued, the rotation balance of the grinding wheel is gradually lost, vibration occurs in the grinding wheel, and the chatter mark is imprinted on the ground surface of the workpiece, which results in the degradation of the plane accuracy. Conventionally, in order to ensure high plane accuracy of the machined surface, a measure has to be taken, in which the grinding machine is stopped during manufacturing and balancing of the grindstone is redone, or in which an expensive automatic balancer is introduced into the facility to correct the lost rotation balance.

After a diligent study of such a problem, the inventor has found that chippings, coolant mist, etc. suspended in the air attach to the grindstone core during grinding and the attached chippings are accumulated on the both end surfaces of the core, which can result in losing the rotation balance of the grinding wheel.

SUMMARY OF THE INVENTION

In light of the new problem of losing the rotation balance of a grinding wheel due to attachment of chippings, an object of the invention is to prevent losing the rotation balance and occurrence of the chatter of the grinding wheel that rotates, without stopping manufacturing and without introducing an expensive automatic balancer.

In order to solve the above problem, the invention is characterized in that a grinding wheel having a grindstone portion formed on a core includes a slippery coating film that prevents attachment of foreign matter, the coating film being provided on a portion of the core, with which portion the foreign matter can be brought into contact.

According to the grinding wheel configured as described above, attachment of foreign matter to the core is prevented by the coating film provided on the portion of the core, with which portion the foreign matter can be brought into contact. Thus, the situation is avoided where the grinding wheel that is rotated is unbalanced due to attachment of foreign matter, such as chippings, vibration in the rotation occurs, and the quality of the ground surface of the workpiece is degraded.

A feature of the invention is that the coating film is a fluoroplastic coating.

According to the grinding wheel configured as described above, the coating film applied on the portion of the core, with which portion foreign matter can be brought into contact, is the fluoroplastic coating. The surface of the fluoroplastic is low in friction, that is, slippery, and is excellent in non-adhesiveness. Thus, attachment of the chippings and coolant, suspended in the air, to the core is effectively prevented.

A feature of the invention is that the coating film is a plating film that contains fluoroplastic.

According to the grinding wheel configured as described above, the coating film applied on the portion of the core, with which portion foreign matter can be brought into contact, is the plating containing fluoroplastic. The surface of the plating is low in friction, that is, slippery, and is excellent in resistance to abrasion. Thus, attachment of the chippings and coolant, suspended in the air, to the core is effectively prevented for a long period of time.

A feature of the invention is that the coating film is a phosphate conversion layer formed by a parkerizing process.

According to the grinding wheel configured as described above, the coating film applied on the portion of the core, with which portion foreign matter can be brought into contact, is formed by a parkerizing process. The surface of the phosphate conversion coating film formed by the parkerizing process is low in friction, that is, slippery. Thus, attachment of the chippings and coolant, suspended in the air, to the core is prevented.

A feature of the invention is that the core is discoid and the grindstone portion is formed on the outer circumferential surface of the core.

According to the grinding wheel configured as described above, the core is discoid and the grindstone portion is formed on the outer circumferential surface of the core. Thus, it is possible to effectively prevent the rotated grinding wheel from being unbalanced by forming the coating film on the both end surfaces of the core, on which surfaces the coating films can be easily formed, without providing the grindstone portion with the coating film for preventing attachment of foreign matter.

A feature of the invention is that the coating film is not provided on a portion for installation onto a grinding machine, which portion is provided at a center portion of each of both end surfaces of the discoid core.

According to the grinding wheel configured as described above, the coating film for preventing attachment of foreign matter is not provided on the portion for installation onto the grinding machine, which portion is provided at a center portion of each of the both end surfaces of the discoid core. Thus, when the discoid core is installed on the grinding machine, the discoid core is firmly fixed without any slip and stably rotated with the rotation of the installation spindle of the grinding machine.

A feature of the invention is that each of the both end surfaces of the discoid core is formed to have a curved surface so that the thickness of the core between the both end surfaces is thin in a center portion of the discoid core and the thickness of the core between the both end surfaces increases toward the periphery of the discoid core.

According to the grinding wheel configured as described above, a curved surface is formed on each of the both end surfaces of the discoid core, the thickness of the core between the both end surfaces is thin in the center portion of the discoid core and, the thickness thereof increases toward the periphery of the discoid core according to a predetermined curvature. Thus, the chippings and the coolant mist attached to the curved surface portions of the both end surfaces are flown toward the periphery of the grinding wheel on the curved surface portions by the centrifugal force generated by the rotation of the grinding wheel and discharged from circumferential portions at which the both curved surfaces and the both end surfaces connect with each other. Thus, the chippings etc. are flown on the both end surfaces of the core toward the periphery by the centrifugal force, so that the situation is effectively avoided where the chippings etc. are accumulated at corner portions at which the both end surfaces of the core and the grindstone portion that slightly protrudes outward relative to the end surfaces of the core meet each other.

BRIEF DESCRIPTION OF THE DRAWINGS

The foregoing and further objects, features and advantages of the invention will become apparent from the following description of example embodiments with reference to the accompanying drawings, wherein like numerals are used to represent like elements and wherein.

DETAILED DESCRIPTION OF EMBODIMENTS

Figure 1:
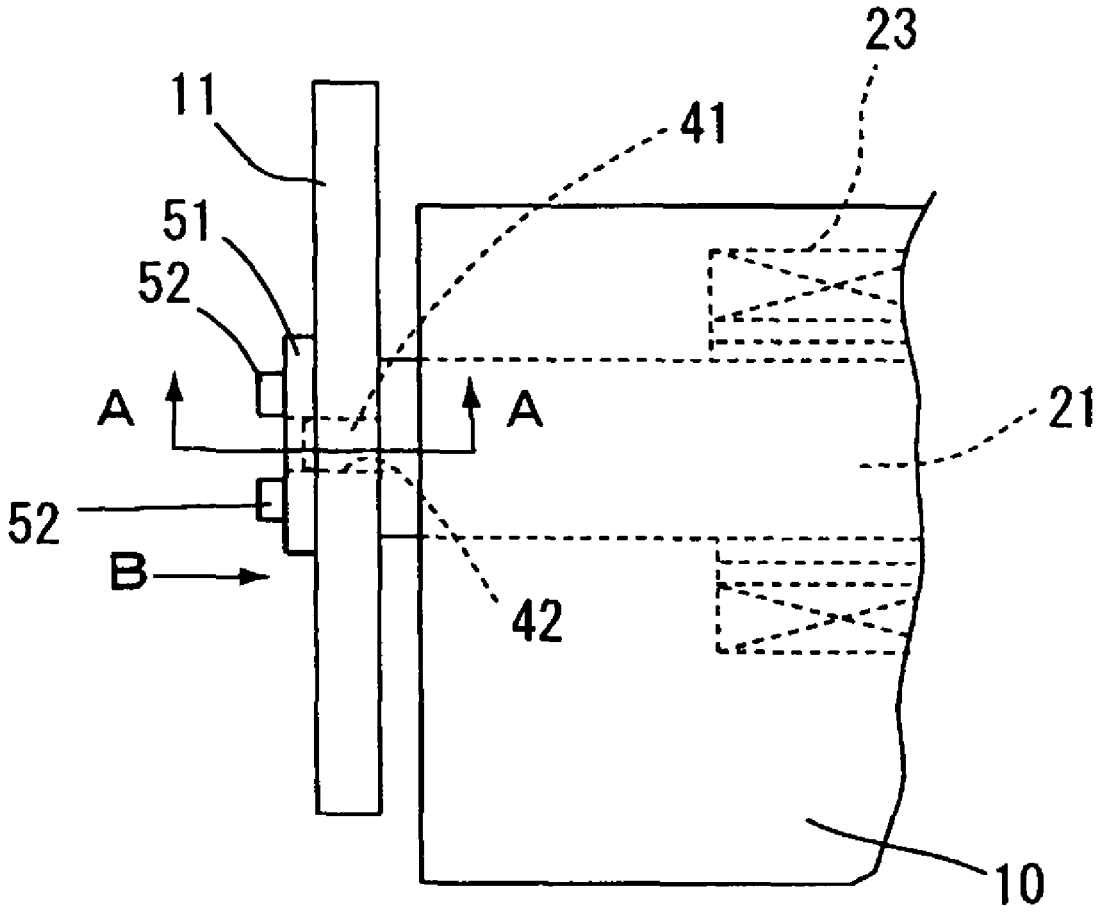
FIG. 1 is a partial side view that shows a state where a grinding wheel of a first embodiment according to the invention is fixed to a wheel head of a grinding machine.

A first embodiment of a grinding wheel 11 according to the invention will be described below with reference to FIGS. 1 to 3. As shown in FIG. 1 that shows part of the side view of a wheel head 10, the grinding wheel 11 is fixed, via a main spindle 21, to the wheel head 10 that moves to and from relative to a workpiece (not shown) on a bed (not shown) of a grinding machine (not shown). The main spindle 21 is rotatably supported by the wheel head 10 via a bearing (not shown) and rotated by a built-in motor 23. A cylindrical boss 41 that is inserted into an inner hole 42 of the grinding wheel 11 when the grinding wheel 11 is fixed to the main spindle 21, is provided on the main spindle 21 so as to protrude from one end of the main spindle 21 coaxially with the main spindle 21. The grinding wheel 11 is fixed on a left end surface 21*a* of the main spindle 21 by a grinding wheel-fixing structure 30 as specifically shown in FIG. 2 (sectional view taken along the line A-A of FIG. 1). The grinding wheel 11 is sandwiched between a substantially discoid flange 51 and the end surface 21*a* of the main spindle 21 and, as shown in FIG. 3, removably fixed on the left end surface 21*a* of the main spindle 21 with a plurality of bolts 52 (equiangularly arranged ten bolts, for example). Thus, bolt insertion holes 53 and 55 that extend in the axial direction are passed through a core 32 of the grinding wheel 11, described later, and the flange 51, respectively, at the same angular positions. The tip screw portions of the bolts 52, which are hexagon socket head cap screws that are passed through the bolt insertion holes 53 and 55, are respectively screwed into screw holes 56, which are open at the end surface of the main spindle 21, whereby the grinding wheel 11 is fixed. Thus, two members, the grinding wheel 11 and the flange 51, are fixed to the end surface 21*a* of the main spindle 21 as a unit by screwing the bolts 52 with the use of a well-known hexagon wrench (not shown). Various roller bearings, slide bearings, fluid dynamic bearings, etc. can be used as the bearing. The driving motor for the main spindle 21 is not limited to the built-in motor 23. A motor that is directly connected to the right end (not shown) of the main spindle 21, a motor that drives, via a belt-type driving mechanism (not shown), a pulley that is fixed to the same end portion, or the like can be employed as the driving motor.

Figure 2:
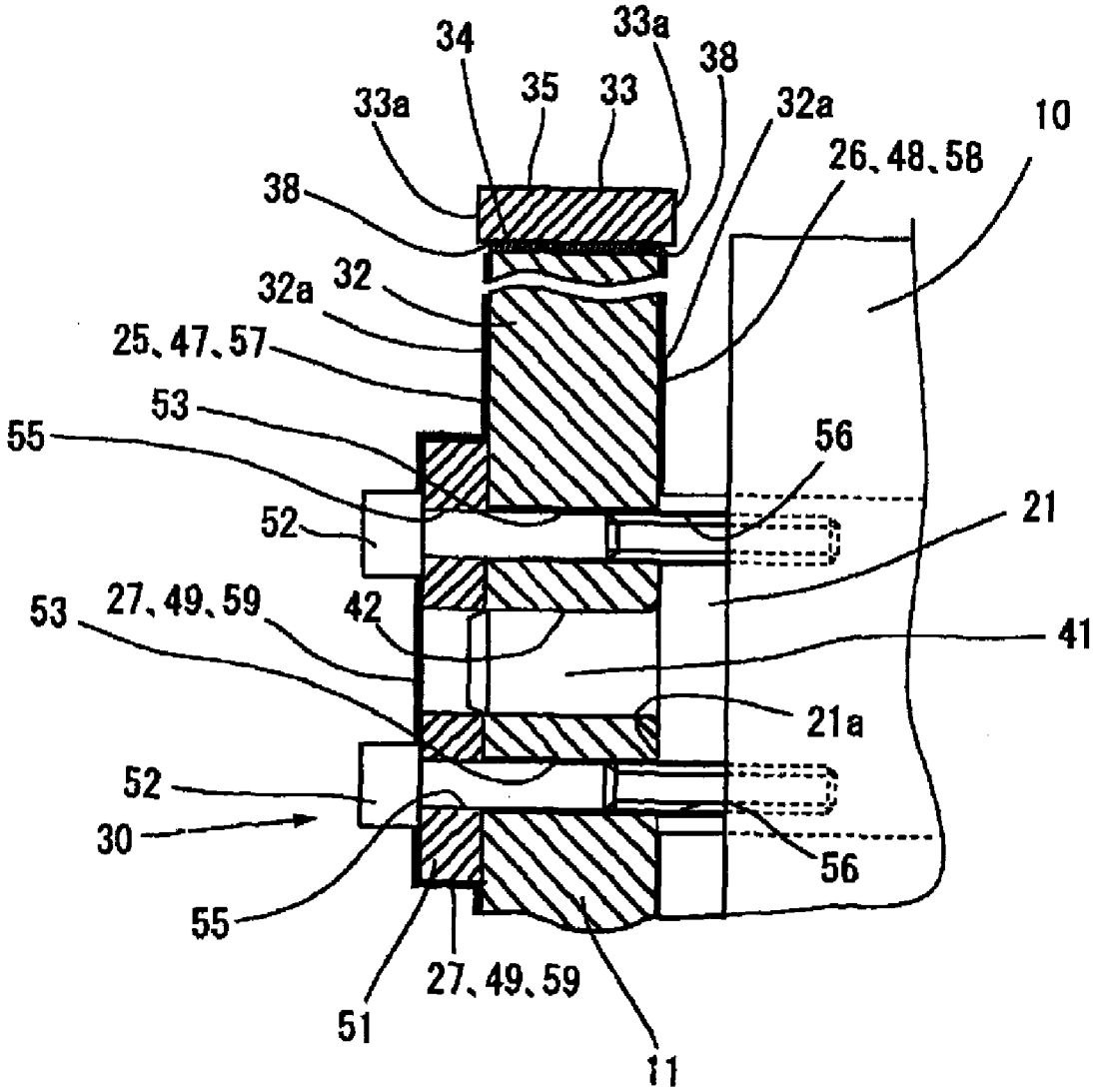
FIG. 2 is a sectional view taken along the line A-A of FIG. 1.
Figure 3:
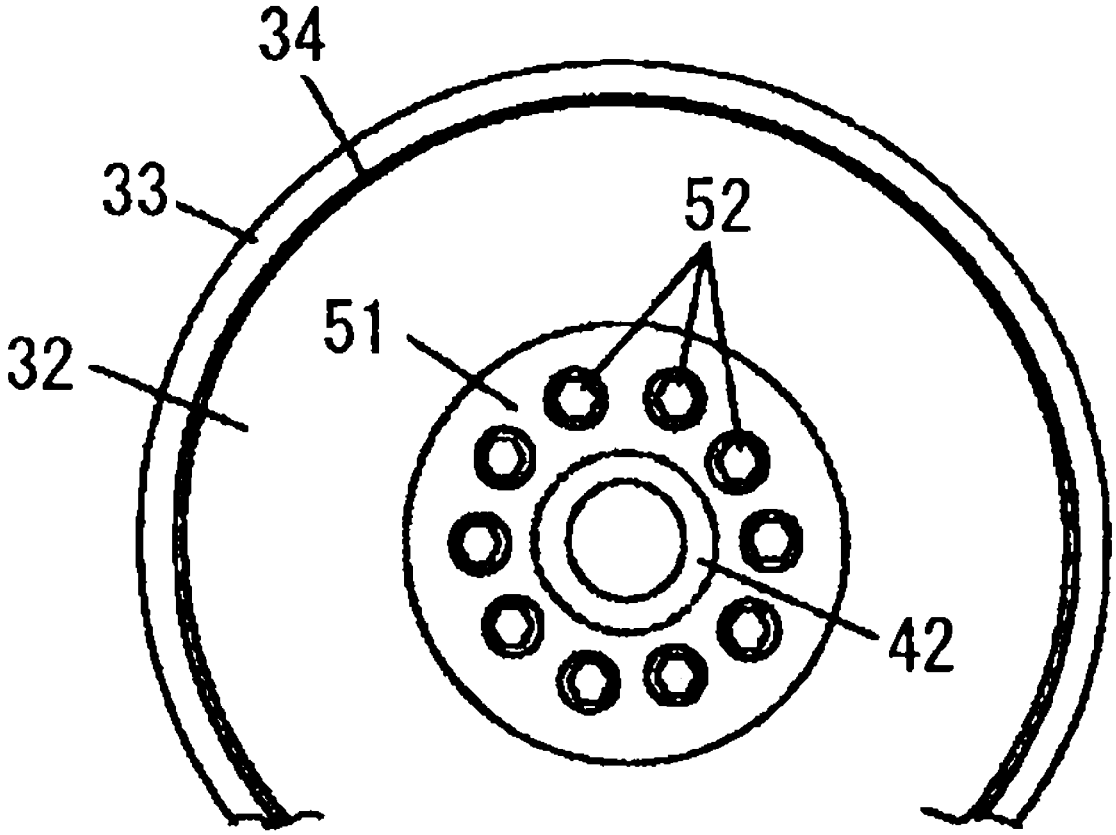
FIG. 3 is a partial front view of the grinding wheel on the arrow B in FIG. 1.

As shown in FIG. 2, the grinding wheel 11 includes the discoid core 32 and a grindstone layer 35, which functions as the grindstone portion, in which a plurality of separate grindstone chips 33 are fixed, and which is formed on the outer circumferential surface of the core 32 with an adhesive layer 34 interposed between the core 32 and the grind stone layer 35. The grindstone chips 33 are obtained by bonding super abrasive grains, such as CBN grains or diamond, with a binder, such as a vitrified bond or a metal bond, in a matrix configuration. A side surface 33*a* of each of the grindstone chips 33 is slightly projected relative to the end surface 32*a* of the core 32 so that the end surface 32*a* of the core 32 and a workpiece do not interfere with each other when an end surface of the workpiece is ground.

The core 32 of the grinding wheel 11 is formed of a steel, such as iron, for example. On both end surfaces 32*a* of the core 32, coating films 25 and 26 for preventing attachment of foreign matter are provided on the portions, with which the flying chippings and/or coolant can be brought into contact when grinding is performed using the grinding wheel 11. The coating films 25 and 26 are preferably such that the friction coefficient of the surface thereof is small, that is, the coating films 25 and 26 have low-friction properties and are therefore slippery, and are not adhesive. Thus, fluoroplastic that has these properties is applied as the coating films 25 and 26. The fluoroplastic herein is, for example, tetrafluoroethylene/perfluoro(alkyl vinyl ether) copolymer (PFA), polytetrafluoroethylene (PTFE), tetrafluoroethylene/hexafluoropropylene copolymer (FEP), polyvinilydene fluoride (PVDF), polychlorotrifluoroethylene (PCTFE), ethylene-chlorotrifluoroethylene copolymer (ECTFE), or the like. In this embodiment, PFA, which is low in friction and excellent in non-adhesiveness and resistance to corrosion, is applied. Which of the fluoroplastics is applied is determined based on the material for the core 32 etc. to be coated and properties of these fluoroplastics.

In the process of coating with fluoroplastic, first, removal of grease from the core 32 etc. that are base materials is performed. Next, a surface-roughing treatment is performed to improve the adhesiveness to the fluoroplastic. The surface-roughing treatment is performed by performing a shot blasting process that roughs the surface of the core 32 etc., with the use of alumina powder or the like and application of the fluoroplastic (PFA) is then performed. When this is performed, surface roughening of the both end surfaces 32*a* of the core 32 may be performed by performing conversion treatment with the use of a chemical agent. Then, the applied fluoroplastic is dried and thereafter, the fluoroplastic coating is finished after a firing step. In order to achieve firm fixation so that a displacement between the grinding wheel 11 and the main spindle 21 does not occur even when the grinding wheel 11 rotates, the portions of the both end surfaces 32*a* of the core 32, with which the flange 51 and the end surface 21*a* of the main spindle 21 are brought into contact, are masked at the time of coating, so that these portions are not provided with the fluoroplastic coating.

The flange 51 is provided with inner holes that have the same diameter as those of the inner holes 42 of the core 32 of the grinding wheel 11. The flange 51 is in close contact with the portion of the left end surface 32*a* of the core 32, which portion is not applied with the fluoroplastic coating film 25, and the bolts 52 are inserted into the bolt insertion holes 55 from the outer side for fixation. The flange 51 is made of steel and receives the pressing force applied by the heads of the bolts 52, so that the flange 51 has a function of distributing the stress due to fastening that concentrates at the portion around each of the bolt insertion holes 53 of the core 32. The diameter of the flange 51 is set significantly greater than that of the circle that the circumferences of the bolt insertion holes 53 provided in the core 32, through which the bolts 52 are passed, touch internally. The diameter of the flange 51 may be set equal to the diameter of the end surface of the main spindle 21 for symmetry. The flange 51 is provided with a coating film 27 that is a fluoroplastic coating similar to the coating film provided on the both end surfaces 32*a* of the core 32 for preventing attachment of foreign matter at the portion with which the coolant and/or chippings suspended in the air can be brought into contact when grinding is performed using the grinding wheel 11.

In the above described embodiment, instead of the coating films 25, 26, and 27, which are the fluoroplastic coatings provided on the both end surfaces 32*a* of the core 32 and the flange 51, coating films 47, 48, and 49, which are electroless nickel-fluoroplastic platings, may be formed on the flange 51 and the both end surfaces 32*a* of the core 32 by an electroless plating process by immersing the core 32 and the flange 51 in a plating solution that is obtained by mixing a predetermined amount of PTFE, which is a fluoroplastic, with a nickel plating solution (see FIG. 2). Also in this way, as in the case of the fluoroplastic coating films 25, 26, and 27, the friction coefficient of the surface of the electroless nickel-fluoroplastic plating films 47, 48, and 49 is small, that is, the coating films 47, 48, and 49 are slippery, and are excellent in resistance to abrasion, so that it is possible to effectively prevent attachment of the chippings, suspended in the air, etc., to the core 32 for a long period of time.

Further, a configuration may be employed, in which phosphate coating films 57, 58, and 59 are provided on the both end surfaces 32*a* of the core 32 and the flange 51 by performing a parkerizing process, instead of the fluoroplastic coating films 25, 26, and 27 provided on the both end surfaces 32*a* of the core 32 and the flange 51 (see FIG. 2). The parkerizing process is a conversion process that produces a coating film made of a phosphate of Mn, Fe, etc. on the surface of a steel material by immersing the steel material into a phosphate solution. As a first step of the process, the core 32 etc. that are base materials, are washed. Then, the core 32 etc. are washed with water and then, a bathing process in a phosphate bath is performed. After the bathing process in the phosphate bath is performed, the workpiece is again washed with water and dried by heated air current, and the process is finished. In the invention, it is preferable that a manganese phosphate coating film, which is slippery, be formed and also in this way, the effects similar to those described above are achieved.

Next, operations will be described. A case will be described where grinding of cams of an automobile camshaft, for example, is performed by the grinding wheel 11 configured as described above. In general, when the cams of an automobile camshaft are ground, in order to ensure a high plane accuracy after grinding, the grinding wheel 11 is rotated at a high speed and the cam surfaces are ground by the grindstone layer 35, which functions as the grindstone portion formed on the outer circumferential surface of the grinding wheel 11. During this process, in order to remove the heat generated due to grinding and to wash away and remove the chippings produced by the grinding, a coolant is sprayed to the vicinity of the point of contact between the cam and the grindstone layer 35 of the grinding wheel 11. The washed-away chippings and the sprayed coolant are scattered into the air and suspended therein and fall downward due to the gravity in a short time. Thereafter, the chippings and the coolant pass through the collecting passage (not shown) provided to collect the coolant and are colleted in the collecting tank (not shown).

However, part of the chippings and coolant that are scattered into the air and suspended therein hit and try to attach to the portions of the both end surfaces 32*a* of the core 32 and the flange 51 of the grinding wheel 11 rotated at a high speed, with which portions the chippings and the coolant can be brought into contact. However, the predetermined portions of the both end surfaces 32*a* of the core 32 and the flange 51 are applied with the fluoroplastic (PFA) coating films 25, 26, and 27 that each have a low friction coefficient and are therefore slippery, so that the chippings and the coolant are scattered due to rotation of the grinding wheel 11 and cannot attach to the grinding wheel 11. Thus, the rotation balance of the grinding wheel 11 is not lost and vibration is not caused, so that the chatter mark is not imprinted on the ground surface and a high quality is maintained. In addition, the portion of the core 32, at which the flange 51 and the left end surface 32*a* of the core 32 are brought into contact with each other, and the portion of the core 32, at which the right end surface 32*a* of the core 32 and the end surface 21*a* of the main spindle 21 are brought into contact with each other, which portions are located at center portions of the both end surfaces 32*a* of the core 32*a* and function as the installation portions for installation onto the grinding machine, are not provided with the fluoroplastic coating films 25 and 26. Thus, the core 32 is firmly fixed without any slip and stably rotated with the rotation of the main spindle 21 of the grinding machine.

In addition, the grindstone layer 35, which functions as the grindstone portion, is formed on the outer circumferential surface of the core 32 of the grinding wheel 11. Thus, it is possible to effectively prevent the occurrence of unbalance of the grinding wheel 11 that is rotated at a high speed, by forming the coating films on the both end surfaces 32*a* of the core 32, on which the coating films can be easily formed, without providing the grindstone layer 35 with the coating film for preventing attachment of foreign matter.

Figure 4:
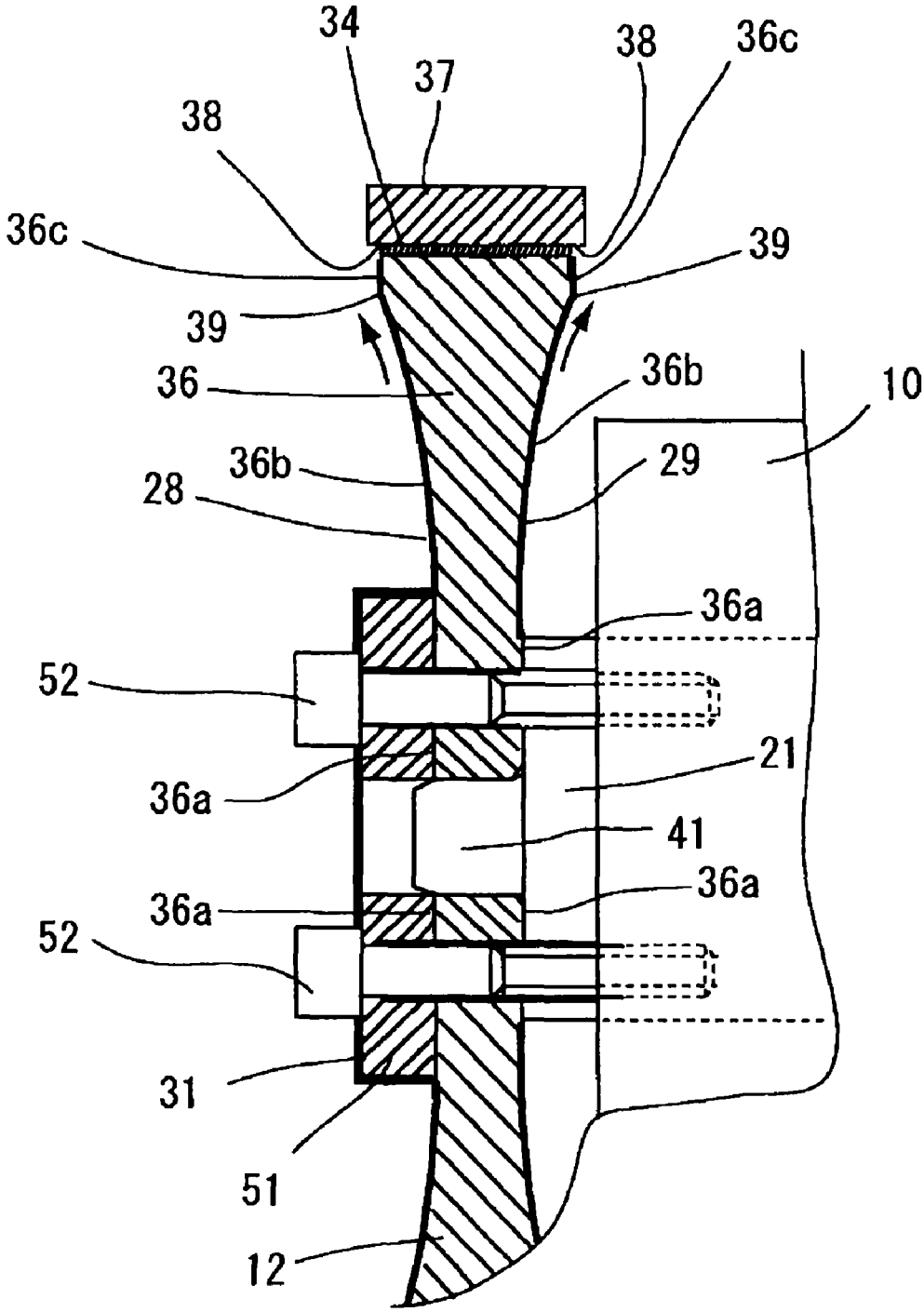
FIG. 4 is a sectional view of a grinding wheel of a second embodiment according to the invention.

Next, a second embodiment according to the invention will be described with reference to FIG. 4. The second embodiment differs from the first embodiment in the shape of the core 32 and therefore, the difference will be described and the description of other operations, construction, etc. that are similar to those of the first embodiment will be omitted. In the second embodiment, as shown in FIG. 4, the discoid core 36 includes: both end surfaces 36*a* at the center portions of the disc that have a circular profile and are parallel with each other; both curved surfaces 36*b* that are formed with a predetermined curvature R from the peripheral circular portions of the both end surfaces 36*a* toward the periphery of the disc of the core 36; and both end surfaces 36*c* that connect between the end portions of the both curved surfaces 36*b* and the peripheries of the core 36 and are parallel with each other.

The outer diameter of the both end surfaces 36*a* of the core 36 is substantially equal to the outer diameter of the flange 51 that is interposed between the heads of the bolts 52 and the left end surface 36*a* of the core 36 when the grinding wheel 12 is fixed to the main spindle 21. The core 36 is formed so that the thickness between the both end surfaces 36*a* is thin. In addition, the both curved surfaces 36*b* are formed with the predetermined curvature R from the peripheral circular portions of the both end surfaces 36*a* toward the periphery of the discoid core 36. The portions of the both curved surfaces 36*b* and the both end surfaces 36*c* of the core 36 and the portion of the flange 51, with which portions the chippings and coolant suspended in the air can be brought into contact when grinding is performed by the grinding wheel 12, are applied with fluoroplastic (PFA) coating films 28, 29, and 31 for preventing attachment of foreign matter that each have a low friction coefficient and are therefore slippery. Thus, although part of the chippings and the coolant suspended in the air hit and try to attach to the flange 51 and the both curved surfaces 36*b* and the both end surfaces 36*c* of the core 36, the chippings etc. are scattered due to rotation of the grinding wheel 12 and do not attach to the grinding wheel 12. In particular, the chippings that try to attach to the both curved surfaces 36*b* of the core 36 are flown toward the periphery of the grinding wheel 12 on the both curved surfaces 36*b* by the centrifugal force generated by the rotation of the grinding wheel 12 and discharged outward (see the arrows) from circumferential portions 39 at which the both curved surfaces 36*b* and the both end surfaces 36*c* connect with each other. Thus, the chippings are not accumulated at corner portions 38 at which the both end surfaces 36*c* of the core 36 and the grindstone layer 37 that slightly protrudes outward relative to the end surfaces 36*c* of the core 36 meet each other. Thus, the chippings do not attach to the core 36, the rotation balance of the grinding wheel 12 is not lost, and vibration is not caused, so that the chatter mark is not imprinted on the ground surface and a high quality is maintained. In addition, the left end surface 36*a* of the core 36, which is a portion at which the flange 51 and the core 36 are in contact with each other, and the right end surface 36*a* that is brought into contact with the end surface 21*a* of the main spindle 21, are not provided with the fluoroplastic coating films 28 and 29. Thus, when the core 32 is installed on the grinding machine, the core 32 is firmly fixed without any slip and stably rotated with the rotation of the main spindle 21 of the grinding machine.

In the second embodiment, the both curved surfaces 36*b* of the core 36 are formed from the periphery of the both end surfaces 36*a* of the core 36. However, considering the ease of manufacturing, it is unnecessary that the position, from which the both curved surfaces 36*b* start, coincide with the periphery of the both end surfaces 36*a*. The curved surfaces 36*b* of the core 36 may start from the positions that are offset radially outward from the peripheries of the both end surfaces 36*a* by a predetermined amount. However, also in this case, the portions of the both end surfaces of the grinding wheel 12, with which portions the main spindle 21 and the flange 51 are brought into contact, are not provided with the fluoroplastic coating films 28 and 29 that are slippery.

In addition, although the grinding wheel 11 according to the invention includes one grinding wheel for grinding a cam on a camshaft, the invention is not limited to this embodiment. For example, the invention can be applied to a grinding machine, in which two grinding wheels are disposed for grinding cams on a camshaft, on which two cams for IN port or OUT port are arranged as in the case of the camshaft for a four-valve engine, for example. In this case, the two grinding wheels are disposed so as to match the arrangement of the cams, with the end surfaces of the two grinding wheels facing each other, and the rotation center portion of each of the two grinding wheels is fixed by one main spindle 21 so as to rotate together. Also in this case, as in the case of the above embodiment, the fluoroplastic coating film is provided on the portion of the core, with which foreign matter, such as chippings, can be brought into contact. The portion, at which the flange 51 and the core of the grinding wheel disposed on the outer side are brought into contact with each other, and the portion, at which the core of the grinding wheel disposed on the inner side and the end surface 21*a* of the main spindle 21 are brought into contact with each other, which portions function as the installation portions for installation onto the grinding machine, are not provided with the fluoroplastic coating films. With this configuration, the situation is avoided where two grinding wheels that are rotated at a high speed is unbalanced due to attachment of foreign matter and vibration in the rotation is caused, resulting in degradation of the quality of the ground surface of the workpiece. In addition, when the two, discoid cores are installed on the grinding machine, the cores are firmly fixed without any slip and are stably rotated with the rotation of the main spindle 21 of the grinding machine.

Although in the first and second embodiments, the cores 32 and 36 that constitute the grinding wheels 11 and 12 are made of steel, such as iron, the invention is not limited to these embodiments. The invention may be applied to a grinding machine in which the core is made of light metal, such as aluminum, or to a grinding machine in which the surface of the core is subjected to various rustproof treatments (black oxidation, various chromate treatments, etc.), and it is expected that similar effects be achieved.

In the description of the first and second embodiments, the grinding wheels 11 and 12 according to the invention are for grinding a cam on a camshaft. However, the invention is not limited to the embodiments. The invention can be applied to a cylindrical grinding machine, a surface grinding machine, and other grinding machines, and it is expected that the effects similar to those achieved by these embodiments be achieved.

The invention claimed is:

1. A grinding wheel comprising:

a core, wherein the core includes a first end surface, a second end surface, and a first radial section, wherein the first radial section has a first thickness that extends from the first end surface to the second end surface;

a grinding layer formed on an outer circumferential surface of the core, wherein the grinding layer is outwardly adjacent to the first radial section in a radial direction, and the grinding layer has a second thickness;

a slippery coating film, wherein the slippery coating film is formed on a portion of the first end surface that corresponds to the first radial section and on a portion of the second end surface that corresponds to the first radial section, wherein the portion of the first end surface that corresponds to the first radial section and the portion of the second end surface that corresponds to the first radial section are brought into contact with foreign matter during an operation of the grinding wheel and the slippery coating film prevents attachment of the foreign matter to the grinding wheel, wherein the second thickness is greater than a combination of the first thickness, a thickness of the slippery coating formed on the portion of the first end surface that corresponds to the first radial section, and the thickness of the slippery coating formed on the portion of the second end surface that corresponds to the first radial section.

2. The grinding wheel according to claim 1, wherein the slippery coating film is a fluoroplastic coating.

3. The grinding wheel according to claim 1, wherein the slippery coating film is a plating film that contains fluoroplastic.

4. The grinding wheel according to claim 1, wherein the slippery coating film is a phosphate conversion layer formed by a parkerizing process.

5. The grinding wheel according to claim 1, wherein the core is discoid.

6. The grinding wheel according to claim 5, wherein the core includes a second radial section provided at a center of the core and extending from the first end surface to the second end surface, the second radial section of the core defines a third thickness, the slippery coating film is not formed on a portion of the first end surface that corresponds to the second radial section, and the slippery coating film is not formed on a section of a portion of the second end surface that corresponds to the second radial section.

7. The grinding wheel according to claim 6, wherein the core includes a third radial section that is radially inward of the first radial section and radially outward of the second radial section, the third radial section extends from the first end face to the second end face and has a fourth thickness, the first thickness of the first radial section is greater than the third thickness of the second radial section such that portions of the first end surface and the second end surface that correspond to the third radial section are curved and the fourth thickness increases along an outward radial direction from the center of the core.

8. The grinding wheel according to claim 1, wherein the portion of the first end surface that corresponds to the first radial section is flat and the portion of the second end surface that corresponds to the first radial section is flat.

9. The grinding wheel according to claim 7, wherein the portion of the first end surface that corresponds to the first radial section is flat and the portion of the second end surface that corresponds to the first radial section is flat.

10. The grinding wheel according to claim 7, wherein the slippery coating film is formed on the portions of the first end surface and the second end surface that correspond to the third radial section.

* * * * *